US005384064A

United States Patent [19]

Peterson

[11] Patent Number: 5,384,064

[45] Date of Patent: Jan. 24, 1995

[54] HYDROCHLORIC ACID PICKLING ACCELERATOR

[75] Inventor: Joseph C. Peterson, Carmel, Ind.

[73] Assignee: Crown Technology, Inc., Indianapolis, Ind.

[21] Appl. No.: 167,576

[22] Filed: Dec. 14, 1993

[51] Int. Cl.[6] ..... C11D 7/08; C23G 1/02

[52] U.S. Cl. ..... 252/142; 252/389.24; 252/79.3; 252/79.4; 252/147; 134/2; 134/3; 134/41

[58] Field of Search ..... 252/142, 146, 147, 389.24, 252/79.2, 79.3, 79.4; 134/2, 3, 41; 204/141.5; 156/625

[56] References Cited

U.S. PATENT DOCUMENTS 3,607,781 9/1971 Kaneko et al. ..... 252/389
3,676,354 7/1972 Kaneko et al. ..... 252/147
4,124,516 11/1978 Shinozaki et al. ..... 252/79.2
4,386,004 5/1983 Jenkins ..... 252/145
4,618,539 10/1986 Jahnke et al. ..... 428/470
4,806,259 2/1989 Amjad ..... 252/80
5,039,441 8/1991 Thomas et al. ..... 252/142

*Primary Examiner*—Paul Lieberman
*Assistant Examiner*—Lorna M. Douyon
*Attorney, Agent, or Firm*—Clifford W. Browning

[57] ABSTRACT

A hydrochloric acid pickling accelerator for batch and continuous hydrochloric acid pickling baths for all types of steel, comprising an admixture of from about 10 to about 15 percent by weight glycol, from about 20 to about 30 percent by weight calcium chloride, from about 3 to about 6 percent by weight phosphoric acid, from about 32 to about 57 percent by weight water, and from about 0.5 to about 2 percent by weight of a fluorinated surfactant.

6 Claims, 5 Drawing Sheets

HYDROCHLORIC ACID PICKLING ACCELERATOR

BACKGROUND OF THE INVENTION

The present invention relates generally to additives for acid pickling baths, and more particularly to an improved additive for hydrochloric acid pickling baths utilized for batch and continuous pickling of all types of steel that accelerates the pickling rate, which reduces raw acid consumption, and that increases the brightness of the pickled steel.

Hot-mill surface scale on steel generally consists of outer layers of iron oxides having high oxygen contents, such as $Fe_2O_3$ and $Fe_3O_4$, an inner layer of iron oxides having low oxygen content, such as FeO, and possibly intermediate layers of mixed iron oxides. In addition to iron oxide scale, the steel may also have surface dirt. Pickling is generally understood to be the chemical removal of the surface scale and dirt with mineral acids, such as sulfuric, hydrochloric, and nitric-hydrofluoric acids.

When iron oxides dissolve in mineral acid pickling baths, the ferrous salt and water are formed. In hydrochloric acid pickling baths, the reactions of the acid with the iron oxides are:

$$Fe_2O_3 + Fe + 6HCl \longrightarrow 3FeCl_2 + 3H_2O$$

$$Fe_3O_4 + Fe + 8HCl \longrightarrow 4FeCl_2 + 4H_2O$$

$$FeO + 2HCl \longrightarrow FeCl_2 + H_2O.$$

When metallic iron reacts with mineral acids, the ferrous salt and hydrogen are formed. In hydrochloric acid pickling baths, the reaction of the acid with the metallic iron is:

$$2HCl + Fe \rightarrow FeCl_2 + H_2.$$

Inhibitors are agents that are added to mineral acid pickling baths to protect the exposed surface of the metallic iron. They do so by inhibiting or retarding the reaction of the acid with the metallic iron without affecting, to an appreciable degree, the pickling action that is removing the iron oxide scale and dirt from the surface. If mineral acid baths were used for pickling without inhibitors, iron oxide scale would be removed, but the acid attack upon the metallic iron would be rapid and severe, depending upon the acid concentration and the pickling bath temperature. Pitting of the metal surface would occur, undesirable changes in the physical properties of the metal could take place, and carbon "smut" could be deposited on the surface. Undesirably large amounts of hydrogen gas would also be generated and released into the surrounding atmosphere, resulting in increased corrosion of all metal in the area of the pickling line. The amount of raw acid consumed would be large, and the volume of waste acid generated would increase. For these reasons, inhibitors are typically added to mineral acid pickling baths.

An effective inhibitor must disperse throughout the pickling bath in low concentrations, it must suppress hydrogen evolution, and it must not leave a smudge or film on time surface of the metal. It must also maintain constant effectiveness over a range of acid and iron concentrations and temperatures.

Accelerators are agents that are added to mineral acid pickling baths for the purpose of lowering the interfacial tension between the surface of the metallic iron and the mineral acid pickling baths to enable the pickling baths to remove iron oxide scale and surface dirt more effectively and for longer periods of time. The mineral acid pickling accelerator additives of the prior art have lengthened the working lives of mineral acid pickling baths, acid consumption has consequently decreased, and the costs of waste pickling acid neutralization and disposal have correspondingly decreased.

State of the prior art mineral acid pickling inhibitors and accelerators are commerically available from Crown Technology, Inc., 7513 E. 96th Street, P.O. Box 50426, Indianapolis, Ind. 46250-0426. The Crown L-60BNF brand non foaming hydrochloric acid inhibitors; the Crown ACID AID 5LXS-IHNF brand non foaming, hydrochloric acid pickling accelerator with a Crown L-60BNF inhibitor in the formulation; and the Activol 1803 brand inhibitor utilized in the comparative tests with the novel hydrochloric acid pickling accelerator of the present invention that follow, are proprietary mixtures of polyethylenepolyamine, coco amine, methenamine, and a proprietary fluorinated surfactant. ACID AID is a Trademark of Crown Technology, Inc., and is Registered upon the Principal Register of the United States Patent and Trademark Office.

SUMMARY OF THE INVENTION

The novel hydrochloric acid pickling accelerators of the present invention, in testing completed to date, increased the rate of descaling of hydrochloric acid pickling baths to a greater degree than did prior art hydrochloric acid pickling inhibitors and accelerators of the prior art, which reduced the consumption of raw hydrochloric acid to a greater degree than did the prior art inhibitors and accelerators, and increased the brightness of descaled steel surfaces to a greater degree than did hydrochloric acid pickling inhibitors and accelerators of the prior art. In comparative testing completed to date with state of the prior art hydrochloric acid pickling inhibitors and accelerators, the novel hydrochloric acid pickling accelerator of the present invention produced up to a 25% faster rate of descaling and up to a 48% whiter or brighter pickled steel surface when added to a typical hydrochloric acid pickling bath to which a state of the prior art inhibitor had been added, than did the same hydrochloric acid pickling bath to which had been added a state of the prior art hydrochloric acid pickling accelerator/inhibitor.

One embodiment of the present invention is a hydrochloric acid pickling accelerator for batch and continuous hydrochloric acid pickling baths for all types of steel, comprising an admixture of from about 10 to about 15 percent by weight glycol, from about 20 to about 30 percent by weight calcium chloride, from about 3 to about 6 percent by weight phosphoric acid, from about 32 to about 57 percent by weight water, and from about 0.5 to about 2 percent by weight of a fluorinated surfactant.

Another embodiment of the present invention is a process for pickling all types of steel comprising, providing a hydrochloric acid pickling bath having a hydrochloric acid inhibitor and from about 1 to about 3 percent: by volume based on the volume of the raw hydrochloric acid in the bath of an admixture of from about 10 to about 15 percent by weight glycol, from about 20 to about 30 percent by weight calcium chloride, from about 3 to about 6 percent by weight phosphoric acid, from about 32 to about 57 percent by weight water, and from about 0.5 to about 2 percent by weight of a fluorinated surfactant, and immersing steel to be pickled in the bath.

It is an object of the present invention to provide a hydrochloric acid pickling accelerator that increases the descaling rate of hydrochloric acid pickling baths to a greater degree than do the state of the prior art prior art hydrochloric acid pickling inhibitors and accelerators.

It is a further object of the present invention to provide a hydrochloric acid pickling accelerator that increases the brightness of the pickled steel surface to a greater degree than do the state of the prior art prior-art hydrochloric acid pickling inhibitors and accelerators.

It is a further object of the present invention to provide a hydrochloric acid pickling accelerator that further reduces the consumption of raw acid in normal hydrochloric acid pickling baths over the reductions obtainable within the state of the prior art hydrochloric acid pickling inhibitors and accelerators.

Related objects and advantages of the novel hydrochloric acid pickling accelerator of the present invention will be evident from the following description of the preferred embodiments.

DESCRIPTION OF THE PREFERRED EMBODIMENTS

Figure 1:
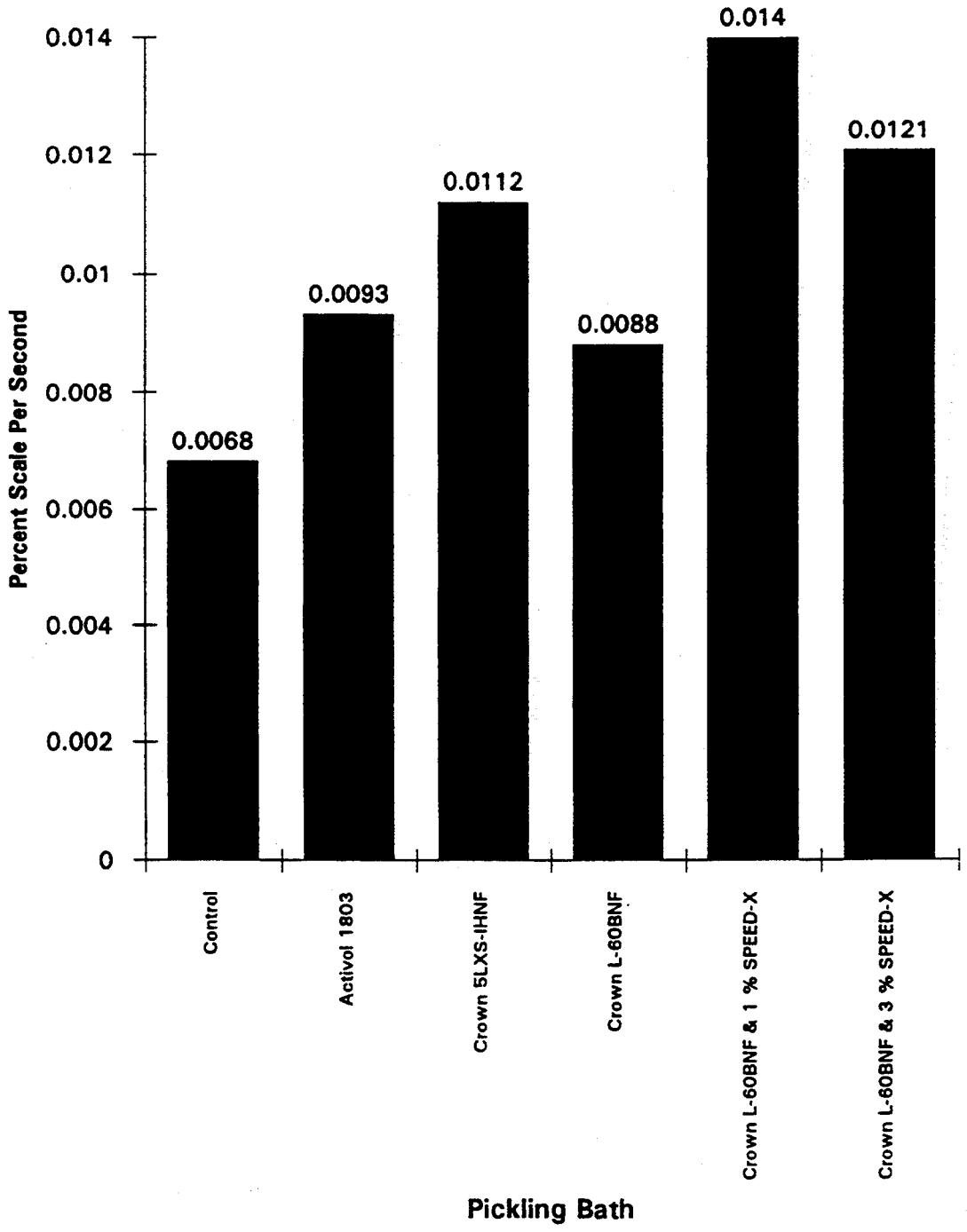
FIG. 1 is a chart of the comparative test data from Table I.
Figure 2:
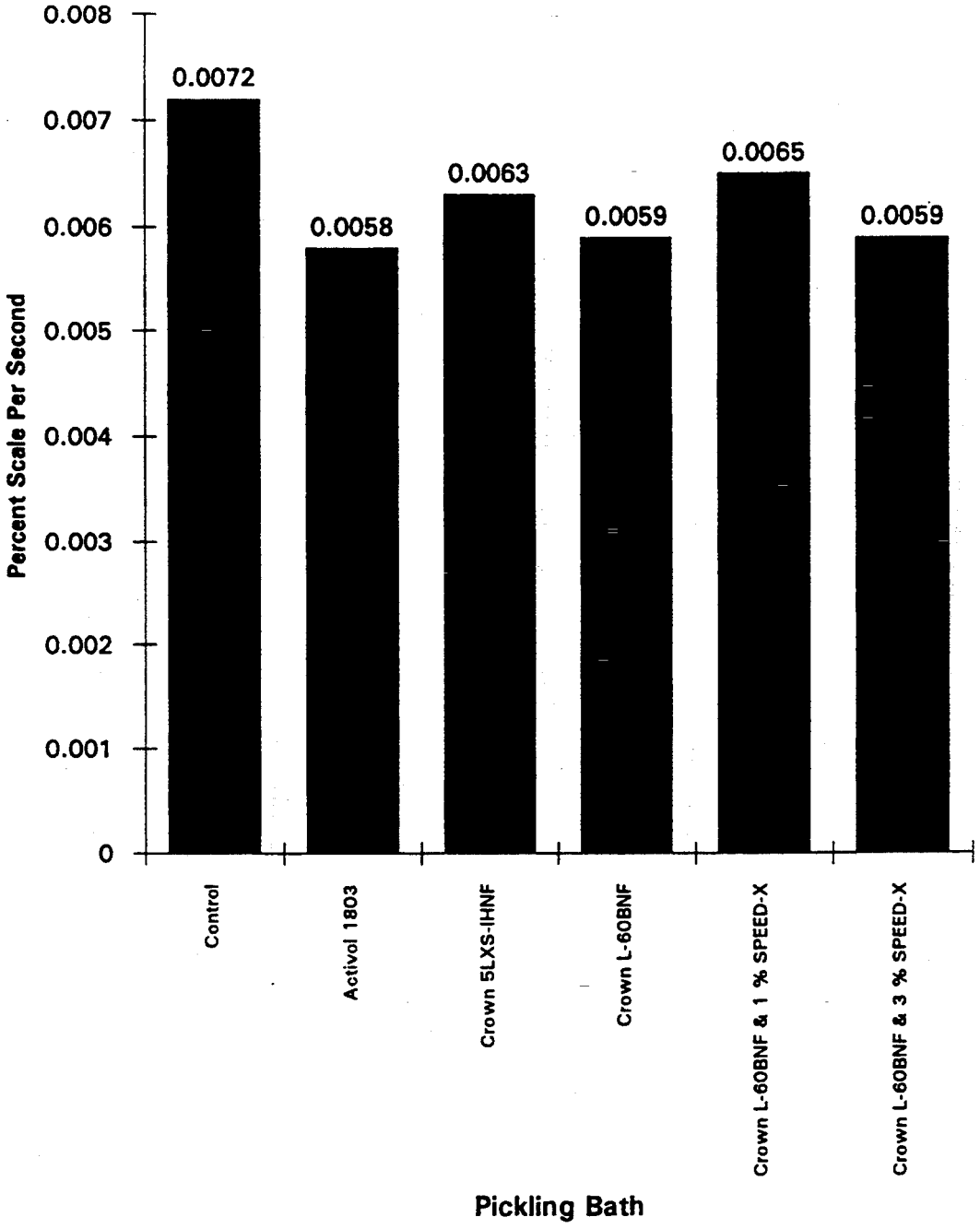
FIG. 2 is a chart of the comparative Lest data from Table II.
Figure 3:
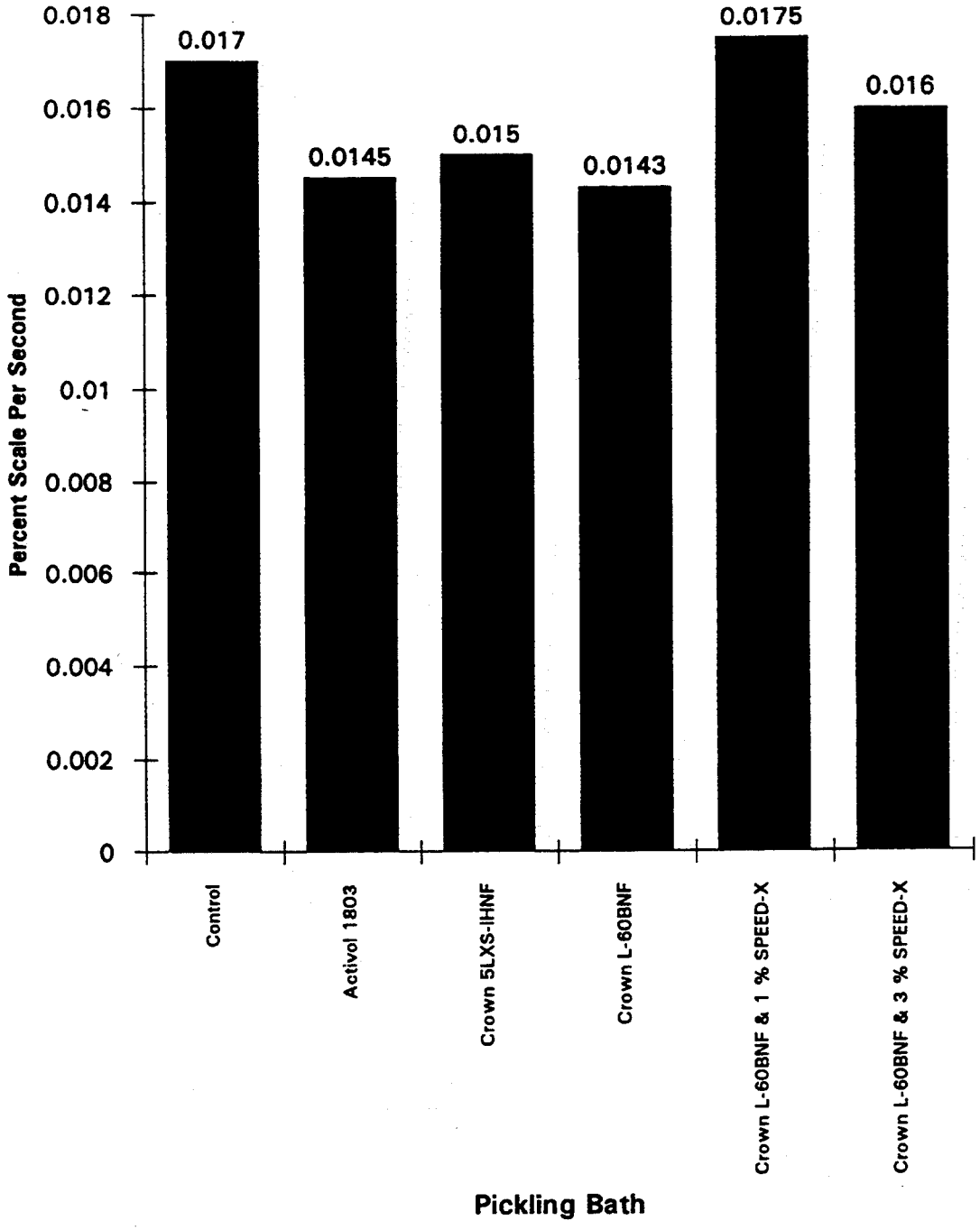
FIG. 3 is a chart of the comparative test data from Table III.
Figure 4:
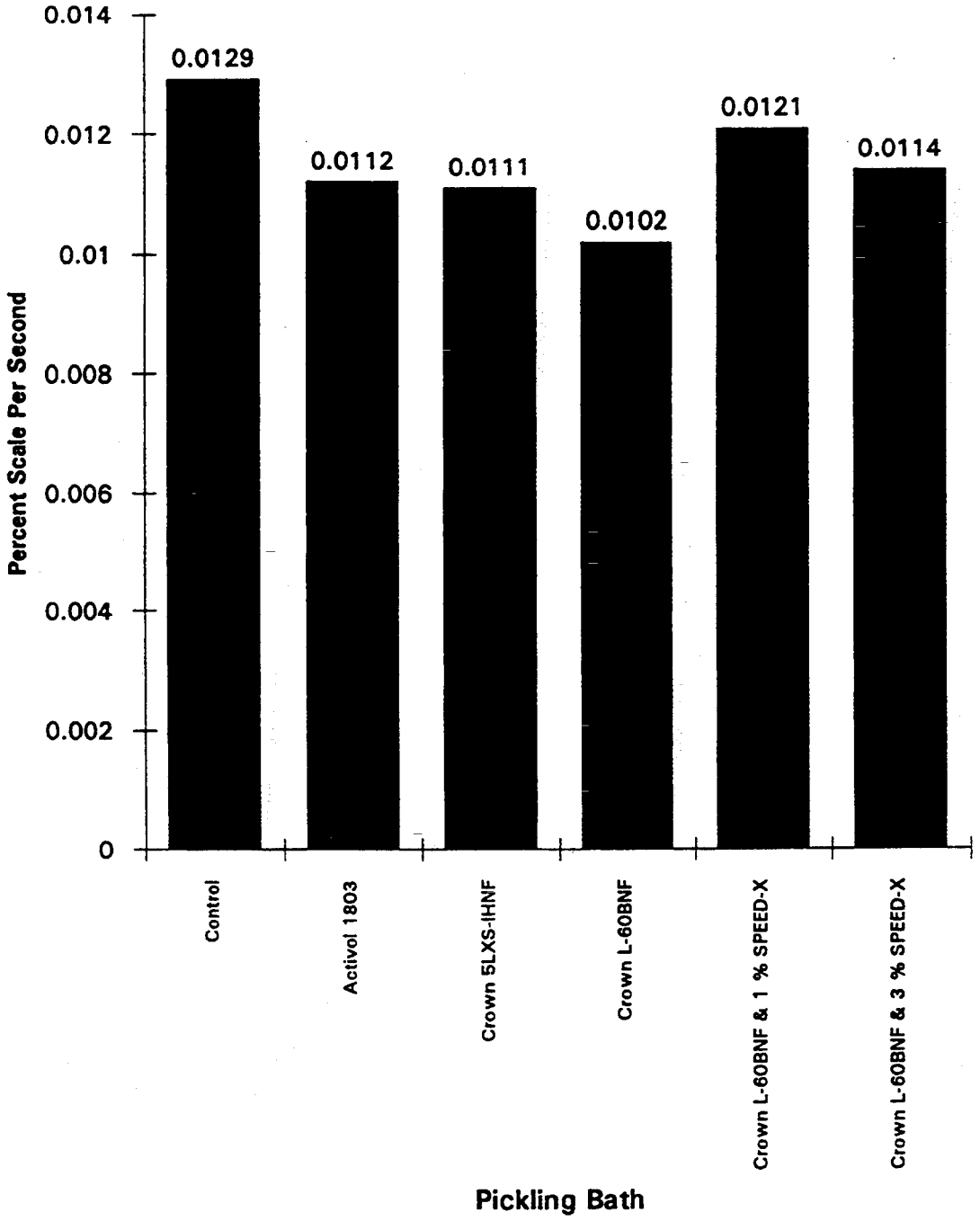
FIG. 4 is a chart of the comparative test data from Table IV.

For the purposes of promoting an understanding of the principles of the invention, reference will now be made to the preferred embodiments of the present invention in the following comparative examples, and specific language will be used to describe the same. It will nevertheless be understood that no limitation of the scope of the invention is thereby intended, such alterations and further modifications in the preferred embodiments, and such further applications of the principles of the invention as described in the following examples being contemplated as would normally occur to one skilled in the art to which the invention relates.

Referring now to FIGS. 1–5, and Tables I–V, and the following comparative tests described in Example 1 from which the data depicted and set forth in the FIGS. and Tables was obtained, hydrochloric acid pickling inhibitors and accelerators of the prior art were compared and contrasted with the most preferred embodiment of the hydrochloric acid pickling accelerators of the present invention in batch hydrochloric acid pickling baths.

In work completed to date, the most preferred hydrochloric acid pickling accelerator of the present invention has been an admixture of about 14% by weight glycol, about 30% by weight calcium chloride, about 4.3% by weight phosphoric acid, about 49.7% by weight water, and about 2% by weight of a commerically available, but proprietary, fluorinated surfactant. The ranges of the percentage weight concentrations for each of these constituents over which they have been effective in the preferred embodiments of the present invention in work completed to date have been about 10 to about 15% by weight glycol, about 20 to about 30% by weight calcium chloride, about 3 to about 6% by weight phosphoric acid, and about 32 to about 57% by weight water, and about 0.5 to about 2.0% by weight of a fluorinated surfactant.

The fluorinated surfactant that has been utilized in the preferred embodiments to dale has been a proprietary fluorochemical surface active agent manufactured and distributed by E. I. Du Pont De Nemours and Company, 1007 Market Street, Wilmington, Del. 19898, denominated "'ZONYL' FSN Fluorosurfactant." ZONYL is a Trademark of E. I. Du Pont De Nemours and Company and is Registered upon the Principal Register of the United States Patent and Trademark Office, Registration No. 703,428, dated Aug. 30, 1960 for "fluorochemical surface active agents." According to DuPont's Material Safety Data Sheet (Number 5969PP) for this material, the chemical family of "'ZONYL' FSN Fluorosurfactant" is "FLUORINATED SURFACTANT," and Du Pont's Registry Number for this product is DP33-99-2. The components of "'ZONYL' FSN Fluorosurfactant" are listed in the Material Safety Data Sheet as being 30% water, 30% isopropyl alcohol, and 40% of a constituent that is a trade secret registered upon the NJ Trade Secret Registry #00850201001-5285P. In light of this identifying data for "'ZONYL FSN Fluorosurfactant," there is reason to believe that whenever the composition of this material is modified, the details recited above from the Material Safety Data Sheet for "'ZONYL' FSN Fluorosurfactant" will also be changed. Other fluorinated surfactants with physical properties similar to "'ZONYL' FSN Fluorosurfactant," may also be used, however.

In the comparative Examples that follow, the most preferred embodiment of the hydrochloric acid pickling accelerator of the present invention (hereinafter referred to as "SPEED-X"), based upon testing completed to date, was compared with the following state of the prior art hydrochloric acid pickling inhibitors and accelerators available from Crown Technology, Inc.:

Activol 1803 (foaming HCl inhibitor with a wetting agent in the formulation).

Crown ACID Air) 5LXS-IHNF (non foaming, HCl accelerator with a Crown L-60BNF inhibitor in the formulation)

Crown L-60BNF (non foaming, HCl inhibitor)

Typical batch hydrochloric acid pickling baths were reproduced, and four different steel types (4 types labeled 1–4 in Tables I–IV, below), each having iron oxide surface scale, were cut into coupons, and were then descaled (pickled) in the manner described below.

EXAMPLE 1

Comparison of Descaling Rates of Activol 1803; ACID AID 5LXS-IHNF; Crown L60BNF; and Crown L60BNF+SPEED-X Baths of 150 ml 6.0% weight per volume (hereinafter "W/V") HCl (16.16% V/V of 20*baume) were related to 180° F. Iron was added in the form of $FeCl_2.4H_2O$ to equal 3.0% W/V iron. Prior art hydrochloric acid inhibitors and accelerator/inhibitors were added to the baths based on the volume of the raw acid in the baths (0.5% by volume based upon the volume of the raw acid in the bath (hereinafter "V/V") of Crown ACID AID 5LXS-IHNF, 0.5% V/V Activol 1803, and 0.25% V/V Crown L-60BNF), and one control bath with no inhibitors or accelerators was established. Typically, inhibitors, only, are used at about 0.25% to about 0.5% V/V in the baths. If higher volume percentages are used, then the pickling speed of the baths slows down.

One percent (1%) V/V SPEED-X was added to one Crown L-60BNF bath and 3% V/V SPEED-X was added to another Crown L-60BNF bath, both based on the volume of the raw acid in the bath. Each bath was used in 1 to 3 descaling trials and an average of the PPS (Percent Per Second) of the scale removal in each bath was determined. A new bath was used for each type of steel pickled. Prior to descaling, the steel was cleaned with acetone and weighed.

After the steel was descaled, it was dip rinsed in a 0.5% solution of NCI-C, a Crown Technology, Inc., neutralizer/corrosion inhibitor, and immediately bagged to prevent oxidation.

After the completion of the descaling trials, the pickled steel was weighed. Calculations were then done to find the percent of scale on each piece and then that percent was divided by the number of seconds it took to descale (DSR) to determine the PPS of the scale removal. The results are tabulated below and graphically depicted in FIGS. 1–4.

TABLE I

| Steel #1 | % Scale | DSR (Seconds) | PPS | Avg. |
|---|---|---|---|---|
| Control | | | | |
| 1. | .382% | 55 sec. | .0069 | .0068 |
| 2. | .364% | 55 sec. | .0066 | |
| 3. | .383% | 55 sec. | .0070 | |
| Activol 1803 | | | | |
| 1. | .644% | 69 sec. | .0093 | .0093 |
| 5LXS-IHNF | | | | |
| 1. | .596% | 55 sec. | .0108 | .0112 |
| 2. | .627% | 55 sec. | .0114 | |
| 3. | .627% | 55 sec. | .0114 | |
| L-60BNF | | | | |
| 1. | .632% | 72 sec. | .0088 | .0088 |
| L-60BNF + 1% SPEED-X | | | | |
| 1. | .598% | 43 sec. | 0.139 | .0140 |
| 2. | .603% | 43 sec. | 0.140 | |
| L-60BNF + 3% SPEED-X | | | | |
| 1. | .641% | 53 sec. | 0.121 | .0121 |
| 2. | .631% | 54 sec. | .0117 | |
| 3. | .618% | 50 sec. | .0124 | |

TABLE II

| Steel #2 | % Scale | DSR (Seconds) | PPS | Avg. |
|---|---|---|---|---|
| Control | | | | |
| 1. | .376% | 52 sec. | .0072 | .0072 |
| 2. | .392% | 53 sec. | .0074 | |
| 3. | .370% | 52 sec. | .0071 | |
| Activol 1803 | | | | |
| 1. | .346% | 59 sec. | .0058 | .0058 |
| 5LXS-IHNF | | | | |
| 1. | .348% | 57 sec. | .0061 | .0063 |
| 2. | .347% | 54 sec. | .0064 | |
| L-60BNF | | | | |
| 1. | .351% | 59 sec. | .0059 | .0059 |
| L-60BNF + 1% SPEED-X | | | | |
| 1. | .361% | 55 sec. | .0066 | .0065 |

TABLE II-continued

| Steel #2 | % Scale | DSR (Seconds) | PPS | Avg. |
|---|---|---|---|---|
| 2. | .367% | 58 sec. | .0063 | |
| L-60BNF + 3% SPEED-X | | | | |
| 1. | .355% | 58 sec. | .0061 | .0059 |
| 2. | .337% | 59 sec. | .0057 | |
| 3. | .352% | 59 sec. | .0060 | |

TABLE III

| Steel #3 | % Scale | DSR (Seconds) | PPS | Avg. |
|---|---|---|---|---|
| Control | | | | |
| 1. | .498% | 29 sec. | .0169 | .0170 |
| 2. | .477% | 28 sec. | .0170 | |
| 3. | .475% | 28 sec. | .0170 | |
| Activol 1803 | | | | |
| 1. | .464% | 32 sec. | 0.145 | .0145 |
| 5LXS-IHNF | | | | |
| 1. | .475% | 32 sec. | .0148 | .0150 |
| 2. | .468% | 31 sec. | .0151 | |
| 3. | .471% | 31 sec. | .0152 | |
| L-60BNF | | | | |
| 1. | .444% | 31 sec. | .0143 | .0143 |
| L-60BNF + 1% SPEED-X | | | | |
| 1. | .474% | 27 sec. | .0175 | .0176 |
| 2. | .470% | 27 sec. | .0174 | |
| L-60BNF + 3% SPEED-X | | | | |
| 1. | .470% | 29 sec. | .0162 | .0160 |
| 2. | .473% | 30 sec. | .0158 | |

TABLE IV

| Steel #4 | % Scale | DSR (Seconds) | PPS | Avg. |
|---|---|---|---|---|
| Control | | | | |
| 1. | .386% | 30 sec. | .0129 | .0129 |
| 2. | .390% | 30 sec. | .0130 | |
| 3. | .396% | 31 sec. | .0127 | |
| Activol 1803 | | | | |
| 1. | .380% | 34 sec. | .0112 | .0112 |
| 5LXS-IHNF | | | | |
| 1. | .383% | 34 sec. | .0112 | .0111 |
| 2. | .366% | 34 sec. | .0108 | |
| 3. | .383% | 34 sec. | .0113 | |
| L-60BNF | | | | |
| 1. | .386% | 38 sec. | .0102 | .0102 |
| L-60BNF + 1% SPEED-X | | | | |
| 1. | .372% | 31 sec. | .0119 | .0121 |
| 2. | .378% | 31 sec. | .0122 | |
| L-60BNF + 3% SPEED-X | | | | |
| 1. | .394% | 35 sec. | .0113 | .0114 |
| 2. | .366% | 32 sec. | .0114 | |

As graphically illustrated in FIGS. 1–4, in work completed to date, the optimum concentration of the most preferred embodiment of the hydrochloric acid pickling accelerator of the present invention (SPEED-X) has been about 1% V/V based on the volume of the raw HCl within a heated batch hydrochloric acid pickling bath. In each of the descaling trials, the addition of SPEED-X at this concentration to a heated batch hydrochloric acid pickling bath in combination with a hydrochloric acid inhibitor to protect the steel surface from acid attack produced a faster rate of descaling than did baths with prior art inhibitors, alone, or baths with accelerators/inhibitors of the prior art. Referring to FIG. 1, the host preferred embodiment of the hydrochloric acid pickling accelerators of the present invention produced up to a 25% faster rate of descaling when added at a concentration of about 1% V/V, to a heated hydrochloric acid pickling bath in which a stale of the prior art inhibitor was present (Crown L-60BNF), than did the same hydrochloric acid pickling bath to which had been added a state of the prior art hydrochloric acid pickling accelerator/inhibitor (Crown ACID AID 5LXS-IHNF).

EXAMPLE 2

Comparison of Whiteness Index of Activol 1803; ACID AID 5LXS-IHNF; Crown L60BNF; and Crown L60BNF+SPEED-X Hydrochloric acid pickling baths leave the surface of pickled steel with a uniformly light gray coloration after the oxide scale has been removed. Brightness tests can determine the degree of brightness, or whiteness, of the pickled steel. Brightness tests were conducted using low carbon steel coupons. Coupons were employed for their flatness, which is a necessary requirement for brightness tests. The baths used for the Steel #4 set of trial baths in Table IV of Example 1 were used again. The coupons were pickled, dip rinsed in NCI-C, and placed in bags to prevent oxidation. The coupons were then measured for brightness on a Photovolt Meter using the Whiteness Index (ASTM method E-313). Amber, blue, and green lenses were employed to get more accurate values. Using the Whiteness Index, the brightness was compared. The higher the Whiteness Index, the brighter the finish on the surface of the steel. The results are tabulated below and graphically depicted in FIG. 5.

TABLE V

| Bath | Amber | Blue | Green | Whiteness Index |
|---|---|---|---|---|
| Control | 26.8 | 24.5 | 26.3 | 9.6 |
| Activol | 22.8 | 20.1 | 22.0 | 7.2 |
| 5LXS-IHNF | 29.1 | 26.4 | 26.2 | 13.5 |
| L-60BNF | 30.0 | 27.5 | 29.5 | 10.8 |
| L-60BNF + 1% SPEED-X | 33.3 | 31.3 | 28.4 | 20.0 |
| L-60BNF + 3% SPEED-X | 32.8 | 29.9 | 28.9 | 16.5 |

Figure 5:
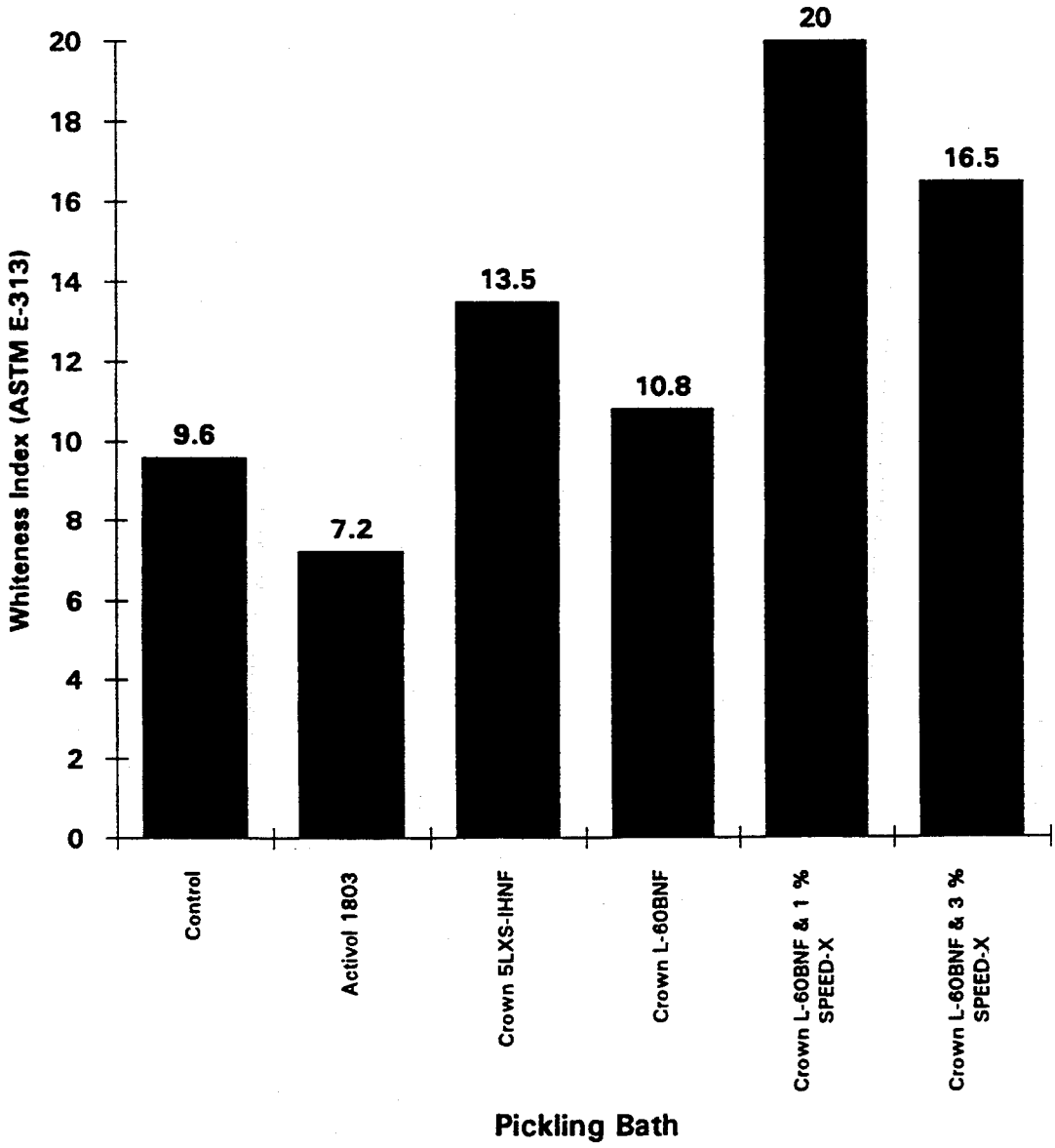
FIG. 5 is a chart of the comparative test data from Table V.

As graphically illustrated in FIG. 5 in work completed to date, the optimum concentration of the most preferred embodiment of the hydrochloric acid pickling accelerator of the present invention (SPEED-X) to produce the brightest pickled steel surface has been 1% V/V based on the volume of the raw HCl within a heated batch hydrochloric acid pickling bath. The addition of SPEED-X at this concentration to a typical heated batch hydrochloric acid pickling bath with a hydrochloric acid inhibitor produced a brighter pickled steel surface than did baths with inhibitors, alone, or than did baths with accelerators/inhibitors of the state of the prior art. Referring to FIG. 5, the most preferred embodiment of the hydrochloric acid pickling accelerators of the present invention produced up to a 48% whiter or brighter pickled steel surface when added at a concentration of about 1% V/V based upon the volume of the raw acid to a heated hydrochloric acid pickling bath to which a state of the prior art inhibitor had been added (Crown L-60BNF), than did the same hydrochloric acid pickling bath to which had been added a state of the prior art hydrochloric acid pickling accelerator/inhibitor (Crown ACID AID 5LXS-IHNF).

The novel hydrochloric acid pickling accelerator of the present invention, in testing completed to date, has out performed state of the prior art hydrochloric acid pickling accelerators and inhibitors by producing faster rates of descaling and brighter pickled steel surfaces. When added to heated batch or continuous hydrochloric acid pickling baths at concentrations ranging from about 1 to about 3% V/V, the hydrochloric acid pickling accelerator of the present invention accelerates the pickling rate, which reduces raw acid consumption, and increases the brightness of the pickled steel.

While the invention has been illustrated and described in detail in the foregoing description, the same is to be considered as illustrative and not restrictive in character, it being understood that only the preferred embodiments have been described, and that all changes and modifications that come within the spirit of the invention are desired to be protected.

What is claimed is:

1. A hydrochloric acid pickling accelerator for batch and continuous hydrochloric acid pickling baths for all types of steel, comprising an admixture of from about 10 to about 15 percent by weight glycol, from about 20 to about 30 percent by weight calcium chloride, from about 3 to about 6 percent by weight phosphoric acid, from about 32 to about 57 percent by weight water, and from about 0.5 to about 2 percent by weight of a fluorinated surfactant.

2. The hydrochloric acid pickling accelerator of claim 1 wherein said admixture is about 14 percent by weight glycol, about 30 percent by weight calcium chloride, about 4.3 percent by weight phosphoric acid, about 49.7 percent by weight water, and about 2 percent by weight of a fluorinated surfactant.

3. A process for pickling all types of steel, comprising a hydrochloric acid pickling bath having a hydrochloric acid inhibitor and from about 1 to about 3 percent by volume based on the volume of the raw hydrochloric acid in the bath of an admixture of from about 10 to about 15 percent by weight glycol, from about 20 to about 30 percent by weight calcium chloride, from about 3 to about 6 percent by weight phosphoric acid, from about 32 to about 57 percent by weight water, and from about 0.5 to about 2 percent by weight of a fluorinated surfactant, and immersing steel to be pickled in said bath.

4. The process of claim 3 wherein said admixture is of about 14 percent by weight glycol, about 30 percent by weight calcium chloride, about 4.3 percent by weight phosphoric acid, about 49.7 percent by weight water, and about 2 percent by weight of a fluorinated surfactant.

5. The process of claim 4 wherein said admixture is present in said bath at about 1 percent by volume based on the volume of the raw hydrochloric acid in the bath.

6. The process of claim 4 wherein said admixture is present in said bath at about 3 percent by volume based on the volume of the raw hydrochloric acid in the bath.

* * * * *

UNITED STATES PATENT AND TRADEMARK OFFICE

CERTIFICATE OF CORRECTION

PATENT NO. : 5,384,064

DATED : January 24, 1995

INVENTOR(S) : Joseph C. Peterson

It is certified that error appears in the above-identified patent and that said Letters Patent is hereby corrected as shown below:

In column 1, line 68, please change the word "time" to --the--.

In column 2, line 67, please delete the colon after the word "percent."

In column 3, line 33, please change the word "Lest" to --test--.

In column 4, line 14, please change the word "dale" to --date--.

In column 4, line 51, please change the word "Air)" to --AID--.

In column 4, line 66, please change the word "related" to --heated--.

In column 6, line 67, please change the word "host" to --most--.

In column 7, line 3, please change the word "stale" to --state--.

Signed and Sealed this

Eighteenth Day of April, 1995

Bruce Lehman

*Attest:*

BRUCE LEHMAN

*Commissioner of Patents and Trademarks*

*Attesting Officer*